US012473790B2

(12) United States Patent
Billingham et al.

(10) Patent No.: US 12,473,790 B2
(45) Date of Patent: Nov. 18, 2025

(54) SYSTEMS AND METHODS FOR ADVANCED FISHING OF DOWNHOLE CABLE WIRE

(71) Applicant: Schlumberger Technology Corporation, Sugar Land, TX (US)

(72) Inventors: Matthew Edward Billingham, Paris (FR); Alberto Abouganem Stephens, Doha (QA); Barry McCallum, Doha (QA); Afsal Areepetta Mannil, Doha (QA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/714,764

(22) PCT Filed: Dec. 5, 2022

(86) PCT No.: PCT/US2022/051812
§ 371 (c)(1),
(2) Date: May 30, 2024

(87) PCT Pub. No.: WO2023/102258
PCT Pub. Date: Jun. 8, 2023

(65) Prior Publication Data

US 2024/0368955 A1 Nov. 7, 2024

Related U.S. Application Data

(60) Provisional application No. 63/285,889, filed on Dec. 3, 2021.

(51) Int. Cl.

| | |
|---|---|
| ***E21B 31/12*** | (2006.01) |
| ***E21B 47/002*** | (2012.01) |
| ***E21B 47/09*** | (2012.01) |

(52) U.S. Cl.
CPC ..... *E21B 31/125* (2013.01); *E21B 47/002* (2020.05); *E21B 47/09* (2013.01)

(58) Field of Classification Search
CPC ..... E21B 31/125; E21B 47/002; E21B 47/09
See application file for complete search history.

(56) References Cited

U.S. PATENT DOCUMENTS

| | | | | |
|---|---|---|---|---|
| 6,041,860 | A | 3/2000 | Nazzal | |
| 2005/0269081 | A1* | 12/2005 | Rose | E21B 31/18 166/301 |

(Continued)

FOREIGN PATENT DOCUMENTS

| | | | |
|---|---|---|---|
| CN | 202970581 | U | 6/2013 |
| CN | 204357390 | U | 5/2015 |
| WO | 2015178901 | A1 | 11/2015 |

OTHER PUBLICATIONS

Search Report and Written Opinion of International Patent Application No. PCT/US2022/051812, Dated Apr. 14, 2023; 9 pages.

(Continued)

*Primary Examiner* — Tara Schimpf
*Assistant Examiner* — Daniel T Craig
(74) *Attorney, Agent, or Firm* — Jeffrey D. Frantz

(57) ABSTRACT

Systems and methods presented herein generally relate to advanced fishing of downhole cables, for example, using camera assemblies to monitor the relative position of a fishing tool with respect to cable wire in substantially real time. For example, systems and methods presented herein include a fishing tool that includes a body portion having a plurality of wire grabbing elements extending therefrom. The wire grabbing elements are configured to penetrate and latch onto cable wire disposed within a borehole of an oil and gas well system. The fishing tool also includes one or more camera assemblies configured to capture images (Continued)

downhole with respect to the fishing tool within the borehole.

16 Claims, 4 Drawing Sheets

(56) References Cited

U.S. PATENT DOCUMENTS

2019/0301258 A1 10/2019 Li
2022/0268120 A1* 8/2022 Al-Shehri ..... E21B 31/12

OTHER PUBLICATIONS

International Preliminary Report on Patentability of International Patent Application No. PCT/US2022/051812 dated Jun. 13, 2024, 7 pages.

* cited by examiner

SYSTEMS AND METHODS FOR ADVANCED FISHING OF DOWNHOLE CABLE WIRE

This application is a National Stage entry of International Patent Application No. PCT/US2022/051812, filed on Dec. 5, 2022, which claims the benefit of U.S. Provisional Application No. 63/285,889 entitled "Systems and Methods for Advanced Fishing of Downhole Cable Wire," filed Dec. 3, 2021, the disclosure of which is incorporated herein by reference.

BACKGROUND

Background

The present disclosure generally relates to systems and methods for advanced fishing of downhole cables, for example, using camera assemblies to monitor the relative position of a fishing tool with respect to cable wire in substantially real time.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Braided cables are used daily globally to convey tools into oil and gas wells to perform a number of different operations. On occasion, an object (e.g., cable, downhole tool, and so forth) may become parted in a well, requiring what is known as a fishing operation to retrieve the object or objects (e.g., a wireline cable and bottom hole assembly attached to a downhole most end of the cable). With respect to fishing cables, there are two main scenarios, which are to fish either a single strand cable, known as a slickline, or a braided line, which may contain electrical conductors, known as an electric line. Historically, a wire finder was run on another cable to locate the top of cable wire depth in the well after the initial breakage, and the top end of the original cable wire was pulled out of the borehole. Having found the top of the cable wire, it was often pushed downwards to create a ball of cable wire in the well. A separate run would then be made with an assembly to latch onto the ball of cable wire. This fishing tool, or latching device, can often be a spear with barbs to penetrate and latch onto the ball and hook into it or a device known as an alligator grab, which generally looks like a set of jaws with barbed teeth, to try and hook on the outer side of the ball of cable wire. Such devices work satisfactorily for single strand cables, but complications arise when used on braided lines.

When braided lines are balled, it locally kinks the cable in multiple places. When this is grabbed and tension is applied to fish the cable, the kinks result in uneven loading on the individual strands and, hence, the breaking strength of the cable wire in this area is greatly reduced. This means most fishing operations result in many runs, each run bringing back only short sections of cable wire that have broken at or near the ball of cable wire. This makes the operations relatively costly.

Typically, such fishing operations have been performed with a slickline in vertical wells. However, there has been an increase in highly deviated wells over the last several years, which might not be able to be served by gravity conveyed slickline alone. Instead, coiled tubing and other pipe, or possibly wireline tractors, might be used. However, in such operations, a lack of sensitivity in tension measurement to easily detect the top of cable wire when fishing is a problem. For example, one can excessively ball the cable wire or run past the ball of cable wire without knowing.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a fishing tool that includes a body portion having a plurality of wire grabbing elements extending therefrom. The wire grabbing elements are configured to penetrate and latch onto cable wire disposed within a borehole of an oil and gas well system. The fishing tool also includes one or more camera assemblies configured to capture images downhole with respect to the fishing tool within the borehole.

Certain embodiments of the present disclosure also include a cable wire fishing system that includes a fishing tool that includes a body portion having a plurality of wire grabbing elements extending therefrom. The wire grabbing elements are configured to penetrate and latch onto cable wire disposed within a borehole of an oil and gas well system. The fishing tool also includes one or more camera assemblies configured to capture images downhole with respect to the fishing tool within the borehole. In addition, the cable wire fishing system includes a control system at a surface location of the oil and gas well system. The control system is configured to facilitate control of a fishing operation performed by the fishing tool based at least in part on the images captured by the one or more camera assemblies of the fishing tool.

Certain embodiments of the present disclosure include a method includes deploying a fishing tool into a borehole of an oil and gas well system. The method also includes capturing images downhole with respect to the fishing tool via one or more camera assemblies of the fishing tool. The method further includes using a control system to control a fishing operation performed by the fishing tool based at least in part on the images captured by the one or more camera assemblies of the fishing tool.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
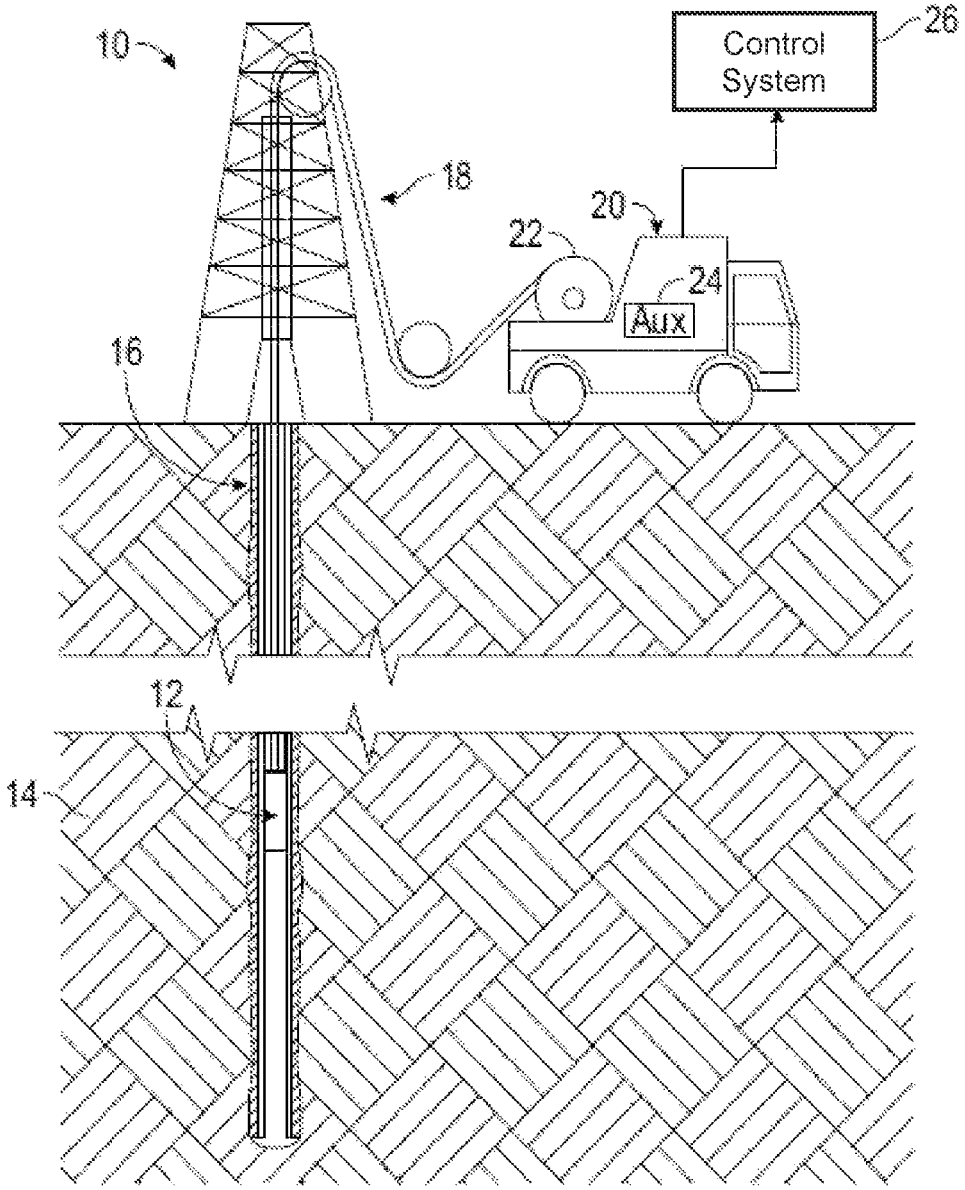
FIG. 1 illustrates an oil and gas well system in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which oil and gas well operations are initiated as being the top (e.g., uphole or upper) point and the total depth along the well axis being the lowest (e.g., downhole or lower) point, whether the well (e.g., wellbore, borehole) is vertical, horizontal or slanted relative to the surface.

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "continuous", "continuously", or "continually" are intended to describe operations that are performed without any significant interruption. For example, as used herein, control commands may be transmitted to certain equipment every five minutes, every minute, every 30 seconds, every 15 seconds, every 10 seconds, every 5 seconds, or even more often, such that operating parameters of the equipment may be adjusted without any significant interruption to the closed-loop control of the equipment. In addition, as used herein, the terms "automatic", "automated", "autonomous", and so forth, are intended to describe operations that are performed, or are caused to be performed, for example, by a computing system (i.e., solely by the computing system, without human intervention). Indeed, although certain operations described herein may not be explicitly described as being performed continuously and/or automatically in substantially real time during operation of the computing system and/or equipment controlled by the computing system, it will be appreciated that these operations may, in fact, be performed continuously and/or automatically in substantially real time during operation of the computing system and/or equipment controlled by the computing system to improve the functionality of the computing system (e.g., by not requiring human intervention, thereby facilitating faster operational decision-making, as well as improving the accuracy of the operational decision-making by, for example, eliminating the potential for human error), as described in greater detail herein.

To overcome the challenges of conventional fishing techniques described above, the embodiments described herein include a fishing tool having a downhole camera to enable operators to see the top of cable wire in the well, and decide in substantially real time the best action to fish the cable wire. The fishing tool described herein may be run on multiple conveyances including, but not limited to, coiled tubing, electric line, and drill pipe.

With the foregoing in mind, FIG. 1 illustrates an oil and gas well system 10 that may employ the systems and methods of this disclosure. The oil and gas well system 10 may be used to convey a downhole tool 12 (e.g., a fishing tool, as described in greater detail herein) through a geological formation 14 via a borehole 16 for the purpose of retrieving (i.e., fishing) cables from within the borehole 16. In the embodiment illustrated in FIG. 1, the fishing tool 12 is conveyed on a cable 18 via a winch system (e.g., vehicle 20). Although the vehicle 20 is schematically illustrated in FIG. 1 as a mobile winch system carried by a truck, the vehicle 20 may instead be substantially fixed (e.g., a long-term installation that is substantially permanent or modular). Any suitable cable 18 for conveying the fishing tool 12 may be used. In certain embodiments, the cable 18 may be spooled and unspooled on a drum 22 and an auxiliary power source 24 may provide energy to the vehicle 20 and/or the fishing tool 12. As also illustrated in FIG. 1, a control system 26 may be used to control operation of the fishing tool 12, as described in greater detail herein. In particular, the control system 26 and the fishing tool 12 may operate in conjunction to retrieve (i.e., fish) cables from within the borehole 16, as described in greater detail herein.

Figure 2:
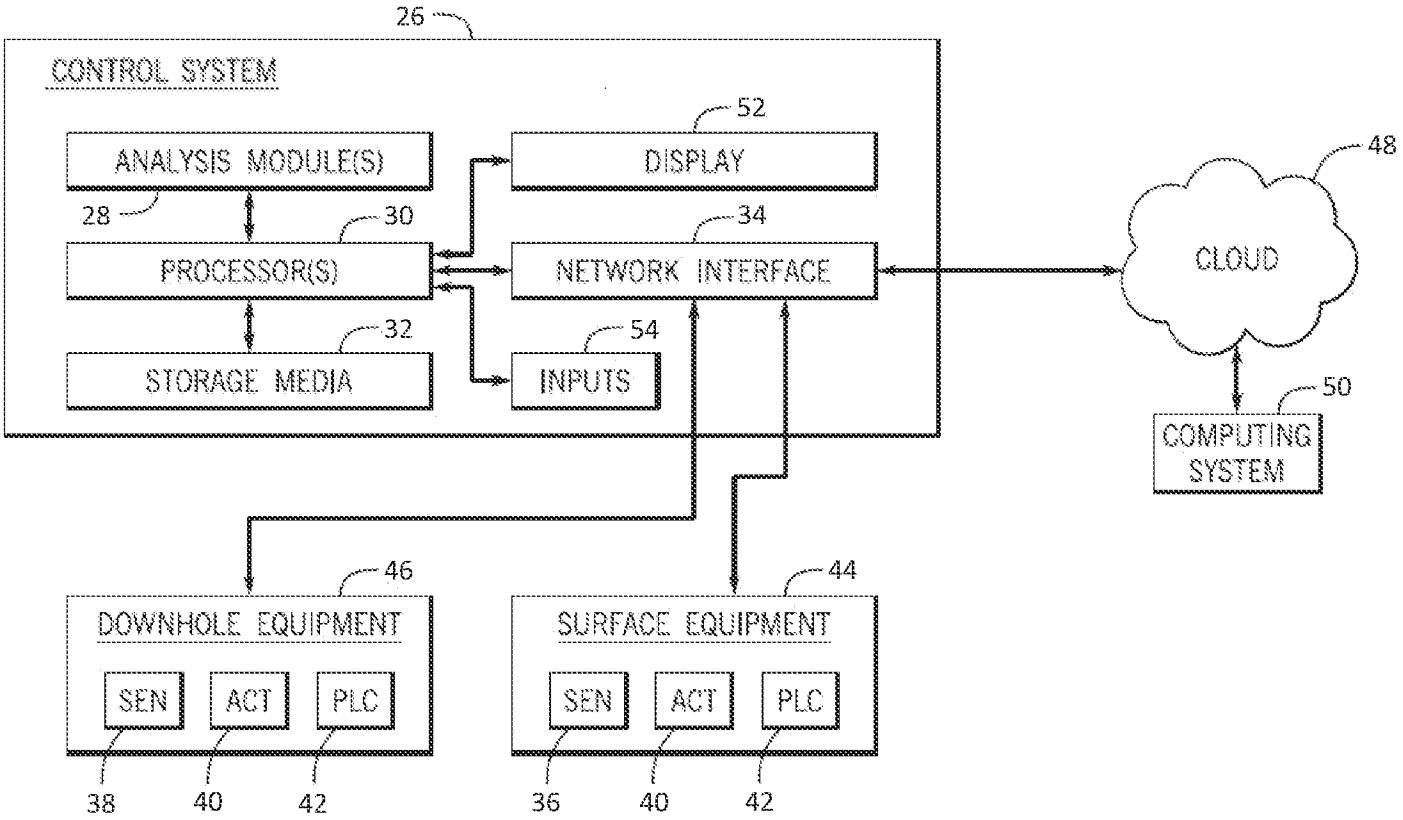
FIG. 2 illustrates a control system that may control the oil and gas well system of FIG. 1, in accordance with embodiments of the present disclosure.

FIG. 2 illustrates an embodiment of the control system 26 illustrated in FIG. 1. In certain embodiments, the control system 26 may include one or more analysis modules 28 (e.g., a program of processor executable instructions and associated data) that may be configured to perform various functions of the embodiments described herein. In certain embodiments, to perform these various functions, an analysis module 28 executes on one or more processors 30 of the control system 26, which may be connected to one or more storage media 32 of the control system 26. Indeed, in certain embodiments, the one or more analysis modules 28 may be stored in the one or more storage media 32.

In certain embodiments, the one or more processors 30 may include a microprocessor, a microcontroller, a processor module or subsystem, a programmable integrated circuit, a programmable gate array, a digital signal processor (DSP), or another control or computing device. In certain embodiments, the one or more storage media 32 may be implemented as one or more non-transitory computer-readable or machine-readable storage media. In addition, in certain embodiments, the one or more storage media 32 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the processor-executable instructions and associated data of the analysis module(s) 28 may be provided on one computer-readable or machine-readable storage medium of the storage media 32, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the one or more storage media 32 may be located either in the machine running the machine-readable instructions, or may be located at a remote site from which machine-readable instructions may be downloaded over a network for execution.

In certain embodiments, the processor(s) 30 may be connected to a network interface 34 of the control system 26 to allow the control system 26 to communicate with various surface sensors 36 and/or downhole sensors 38 described herein, as well as communicate with various actuators 40 and/or PLCs 42 of surface equipment 44 (e.g., surface pumps, valves, and so forth) and/or of downhole equipment 46 (e.g., the fishing tool 12, electric submersible pumps, other downhole tools, and so forth) for the purpose of controlling operation of the oil and gas well system 10. In certain embodiments, the network interface 34 may also facilitate the control system 26 to communicate data to a cloud-based service 48 (or other wired and/or wireless communication network) to, for example, archive the data or to enable external computing systems 50 (e.g., cloud-based computing systems, in certain embodiments) to access the data and/or to remotely interact with the control system 26. For example, in certain embodiments, some or all of the analysis modules 28 described in greater detail herein may be executed via cloud and edge deployments.

In certain embodiments, the control system 26 may include a display 52 configured to display a graphical user interface to present results on the control of the fishing operations described herein. In addition, in certain embodiments, the graphical user interface may present other information to operators of the equipment 44, 46 described herein. For example, the graphical user interface may include a dashboard configured to present visual information to the operators. In certain embodiments, the dashboard may show live (e.g., real-time) data as well as the results of the control of the fishing operations described herein.

In addition, in certain embodiments, the control system 26 may include one or more input devices 54 configured to enable operators to, for example, provide commands to the equipment 44, 46 described herein. For example, in certain embodiments, the fishing tool 12 may provide information to the operators regarding the fishing operations, and the operators may implement actions relating to the fishing operations by manipulating the one or more input devices 54, as described in greater detail herein. In certain embodiments, the display 52 may include a touch screen interface configured to receive inputs from operators. For example, an operator may directly provide instructions to the fishing tool 12 via the user interface, and the instructions may be output to the fishing tool 12 via a controller and a communication system of the fishing tool 12.

It should be appreciated that the control system 26 illustrated in FIG. 2 is only one example of a well control system, and that the control system 26 may have more or fewer components than shown, may combine additional components not depicted in the embodiment of FIG. 2, and/or the control system 26 may have a different configuration or arrangement of the components depicted in FIG. 2. In addition, the various components illustrated in FIG. 2 may be implemented in hardware, software, or a combination of both hardware and software, including one or more signal processing and/or application specific integrated circuits. Furthermore, the operations of the control system 26 as described herein may be implemented by running one or more functional modules in an information processing apparatus such as application specific chips, such as application-specific integrated circuits (ASICs), field-programmable gate arrays (FPGAs), programmable logic devices (PLDs), systems on a chip (SOCs), or other appropriate devices. These modules, combinations of these modules, and/or their combination with hardware are all included within the scope of the embodiments described herein.

As described above, the embodiments described herein include a fishing tool 12 having one or more camera assemblies 56 to enable operators to see the top of cable wire in the well, and decide in substantially real time the best action to fish the cable wire. The fishing tool 12 described herein may be run on multiple conveyances including, but not limited to, coiled tubing, electric line, and drill pipe. In certain embodiments, the camera assemblies 56 package electronics within the fishing tool 12, and the body of the fishing tool 12 is typically thin. As such, the fishing tool 12 may not, by itself, be particularly robust, which is required for fishing operations. Therefore, in certain embodiments, the fishing tool 12 may be run into the borehole 16 attached to a structurally stronger element of the conveyance systems. For example, the embodiments illustrated below are described as including coiled tubing 58.

Figures 3, 4, 5, 6:
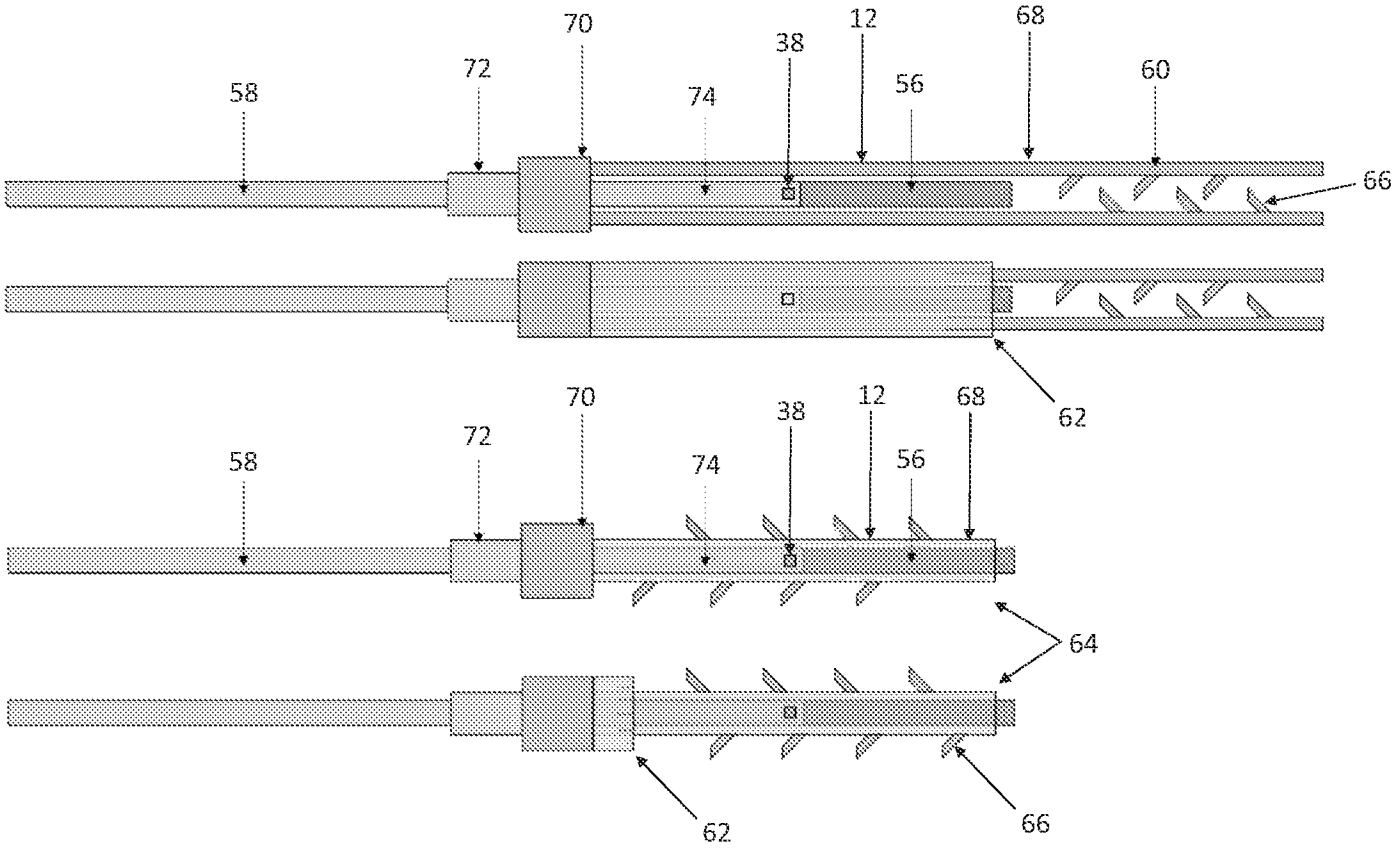
FIG. 3 illustrates a fishing tool that includes one or more camera assemblies and an alligator wiregrab, in accordance with embodiments of the present disclosure.
FIG. 4 illustrates a fishing tool that includes one or more camera assemblies and an alligator wiregrab and a wire finder, in accordance with embodiments of the present disclosure.
FIG. 5 illustrates a fishing tool that includes one or more camera assemblies and a fishing spear, in accordance with embodiments of the present disclosure.
FIG. 6 illustrates a fishing tool that includes one or more camera assemblies and a fishing spear and a wire finder, in accordance with embodiments of the present disclosure.

In particular, two versions of the fishing tool 12 described herein are illustrated in FIGS. 3-6, namely, a fishing tool 12 that includes one or more camera assemblies 56 and an alligator wiregrab 60 disposed near a downhole location of the fishing tool 12 (FIG. 3) that may be run in combination with a wire finder 62 disposed at an uphole location of the fishing tool 12 (FIG. 4) and configured to locate and ball-up a top portion of cable wire, and a fishing tool 12 that includes one or more camera assemblies 56 and a fishing spear 64 (FIG. 5) that may also be run in combination with a wire finder 62 (FIG. 6). As illustrated in FIGS. 3 and 4, the wire grabbing elements 66 (e.g., a set of jaws with barbed teeth) of the fishing tool 12 are disposed on an inner wall of a cylindrical body portion 68 of the fishing tool 12. Conversely, as illustrated in FIGS. 5 and 6, the wire grabbing elements 66 of the fishing tool 12 are disposed on an outer wall of a cylindrical body portion 68 of the fishing tool 12.

In certain embodiments, a fishing tool connector 70 of the fishing tool 12 may be disposed at an uphole end of the fishing tool 12 and configured to directly couple with a mating coiled tubing connector 72 disposed at a downhole end of the coiled tubing 58 to couple the fishing tool 12 to the coiled tubing 58 so as to be strong enough to be able to perform the fishing operations described herein. In addition, in certain embodiments, the fishing tool 12 may include a communications adaptor 74 configured to facilitate communications (e.g., fiber optic, electrical, or a combination thereof) with the control system 26 of FIG. 2 via the coiled tubing 58. In certain embodiments, the communications adaptor 74 may include a telemetry section to convey data signals from the camera assemblies 56 to the control system 26 of FIG. 2 by electrical and/or optical means via the coiled tubing 58 for the purpose of controlling the fishing operations described herein. As described above with reference to FIG. 2, in certain embodiments, the fishing tool 12 may also include other downhole sensors 38 such as, but not limited to, pressure sensors, temperature sensors, tension/compression sensors, flow rate sensors, and so forth, which may detect and provide additional data signals relating to other downhole operating parameters to the control system 26 of FIG. 2 via the coiled tubing 58 for the purpose of controlling the fishing operations described herein. In certain embodiments, the fishing tool 12 may also be run on an electric line.

Using the fishing tools 12 illustrated in FIGS. 3-6, an operator may be able to visually monitor what is directly below the fishing tool 12 downhole within the borehole 16 as the fishing tool 12 is run into the well in order to locate the top of the cable wire and commence fishing. For example, the operator may run the fishing tool 12 to within several hundred feet of the top of the cable wire, and then movement of the fishing tool 12 down to monitor the position of the cable wire relative to the fishing tool 12 within the borehole 16 in substantially real time to identify the exact location of the top of the cable wire relative to the fishing tool 12. In certain embodiments where coiled tubing 58 is used to deploy the fishing tool 12 into the borehole 16, circulation of fluids may be used to provide relatively clean fluids such that relatively clear images may be captured by the camera assemblies 56. Based on these relatively clear images, the operator may decide in substantially real time corrective actions to take to commence fishing operations.

Figure 7:
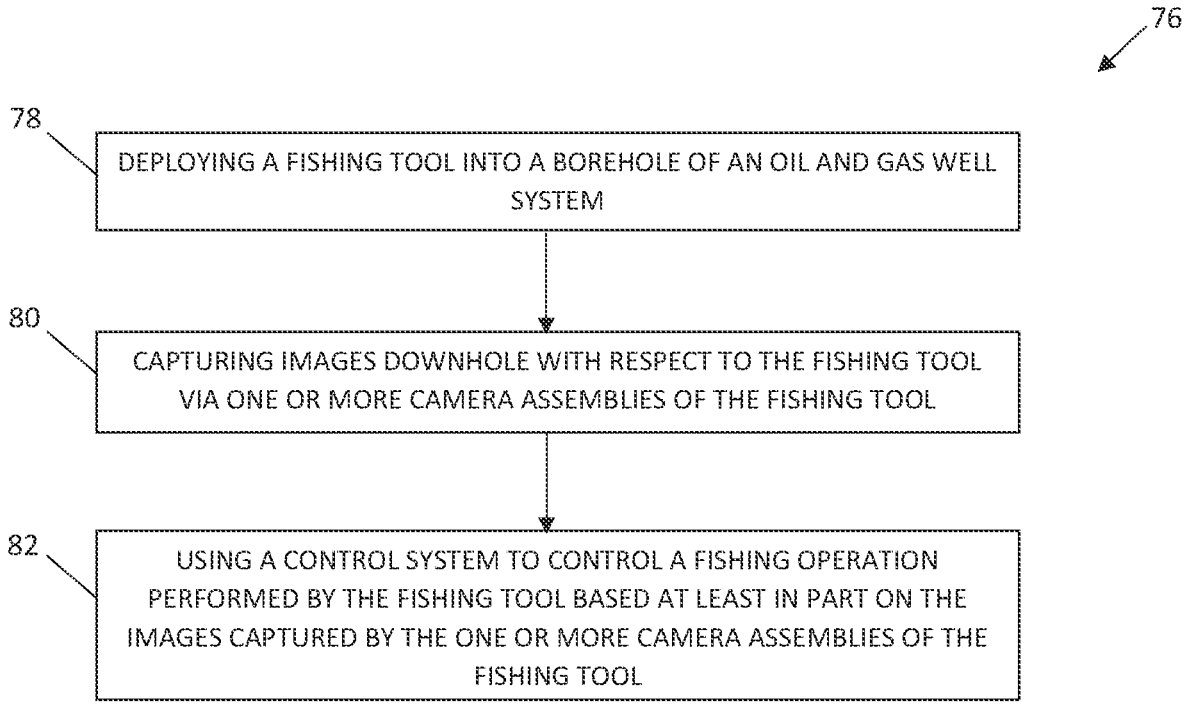
FIG. 7 is a flow diagram of a method of operation of the fishing tools illustrated in FIGS. 3-6, in accordance with embodiments of the present disclosure.

FIG. 7 is a flow diagram of a method 76 of operation of the fishing tools 12 illustrated in FIGS. 3-6. As illustrated in FIG. 7, in certain embodiments, the method 76 includes deploying a fishing tool 12 into a borehole 16 of an oil and gas well system 10 (block 78). In addition, in certain embodiments, the method 76 includes capturing images downhole with respect to the fishing tool 12 via one or more camera assemblies 56 of the fishing tool 12 (block 80). In addition, in certain embodiments, the method 76 includes using a control system 26 to control a fishing operation performed by the fishing tool 12 based at least in part on the images captured by the one or more camera assemblies 56 of the fishing tool 12 (block 82).

In addition, in certain embodiments, the method 76 includes directly coupling a fishing tool connector 70 disposed at an uphole end of the fishing tool 12 to a coiled tubing connector 72 disposed at a downhole end of coiled tubing 58 used to deploy the fishing tool 12 into the borehole 16. In addition, in certain embodiments, the method 76 includes utilizing a communications adaptor 74 of the fishing tool 12 to facilitate communications with the control system 26 via the coiled tubing 58 used to deploy the fishing tool 12 into the borehole 16. In addition, in certain embodiments, the method 76 includes detecting and providing data signals relating to downhole operating parameters to the control system 26 via one or more downhole sensors 38 of the fishing tool 12.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

In the claims, means-plus-function clauses are intended to cover the structures described herein as performing the recited function and not only structural equivalents, but also equivalent structures. Thus, for example, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

The invention claimed is:

1. A fishing tool, comprising:

a body portion defined by an uphole end and a downhole end;

plurality of wire grabbing elements positioned on an interior surface of the body portion and extending inwardly therefrom, the plurality of wire grabbing elements positioned proximate to the downhole end, wherein the wire grabbing elements are configured to penetrate and latch onto cable wire disposed within a borehole of an oil and gas well system;

one or more camera assemblies positioned within the body portion and located uphole relative to the plurality of wire grabbing elements, the one or more camera assemblies configured to capture images downhole with respect to the fishing tool within the borehole;

a communications adaptor positioned within the body portion and located uphole relative to the one or more camera assemblies; and one or more sensors positioned on the communications adaptor.

2. The fishing tool of claim 1, comprising a wire finder disposed at an uphole location of the fishing tool, wherein the wire finder is configured to locate and ball-up a top portion of cable wire.

3. The fishing tool of claim 1, comprising a fishing tool connector disposed proximate to the uphole end of the body portion, wherein the fishing tool connector is configured to directly couple the fishing tool to a coiled tubing connector disposed at a downhole end of coiled tubing used to deploy the fishing tool into the borehole.

4. The fishing tool of claim 1, wherein the communications adaptor is configured to facilitate communications with a control system at a surface location of the oil and gas well system via coiled tubing used to deploy the fishing tool into the borehole.

5. The fishing tool of claim 4, wherein the communications adaptor conveys data signals to the control system using electrical and/or optical means.

6. The fishing tool of claim 4, wherein the one or more sensors are configured to detect and provide data signals relating to downhole operating parameters to the control system.

7. A cable wire fishing system, comprising:

a fishing tool, comprising:

a body portion defined by an uphole end and a downhole end;

a plurality of wire grabbing elements positioned on an interior surface of the body portion and extending inwardly therefrom, the plurality of wire grabbing elements positioned proximate to the downhole end, wherein the wire grabbing elements are configured to penetrate and latch onto cable wire disposed within a borehole of an oil and gas well system;

one or more camera assemblies positioned within the body portion and located uphole relative to the plurality of wire grabbing elements, the one or more camera assemblies configured to capture images downhole with respect to the fishing tool within the borehole;

a communications adaptor positioned within the body portion and located uphole relative to the one or more camera assemblies; and one or more sensors positioned on the communications adaptor; and a control system at a surface location of the oil and gas well system, wherein the control system is configured to facilitate control of a fishing operation performed by the fishing tool based at least in part on the images captured by the one or more camera assemblies of the fishing tool.

8. The cable wire fishing system of claim 7, wherein the fishing tool comprises a wire finder disposed at an uphole location of the fishing tool, wherein the wire finder is configured to locate and ball-up a top portion of cable wire.

9. The cable wire fishing system of claim 7, wherein the fishing tool comprises a fishing tool connector disposed proximate to the uphole end of the body portion, wherein the fishing tool connector is configured to directly couple the fishing tool to a coiled tubing connector disposed at a downhole end of coiled tubing used to deploy the fishing tool into the borehole.

10. The cable wire fishing system of claim 7, wherein the fishing tool comprises a communications adaptor configured to facilitate communications with the control system via coiled tubing used to deploy the fishing tool into the borehole.

11. The cable wire fishing system of claim 10, wherein the communications adaptor conveys data signals to the control system using electrical and/or optical means.

12. The cable wire fishing system of claim 10, wherein the one or more downhole sensors are configured to detect and provide data signals relating to downhole operating parameters to the control system.

13. A method, comprising:

deploying a fishing tool into a borehole of an oil and gas well system, the fishing tool comprising a body portion, a plurality of wire grabbing elements positioned on an interior surface of the body portion and extending inwardly therefrom, and one or more camera assemblies positioned within the body portion and located uphole relative to the plurality of wire grabbing elements;

capturing images downhole with respect to the fishing tool via one or more camera assemblies of the fishing tool; and using a control system to control a fishing operation performed by the fishing tool based at least in part on the images captured by the one or more camera assemblies of the fishing tool.

14. The method of claim 13, comprising directly coupling a fishing tool connector disposed at an uphole end of the fishing tool to a coiled tubing connector disposed at a downhole end of coiled tubing used to deploy the fishing tool into the borehole.

15. The method of claim 13, comprising utilizing a communications adaptor of the fishing tool to facilitate communications with the control system via coiled tubing used to deploy the fishing tool into the borehole.

16. The method of claim 13, comprising detecting and providing data signals relating to downhole operating parameters to the control system via one or more downhole sensors of the fishing tool.

* * * * *